United States Patent [19]

Fox

[11] Patent Number: 4,876,485

[45] Date of Patent: Oct. 24, 1989

[54] BALLAST FOR IONIC CONDUCTION LAMPS

[76] Inventor: Leslie Z. Fox, 2712 Colby Ave., West Los Angeles, Calif. 90064

[21] Appl. No.: 132,946

[22] PCT Filed: Feb. 10, 1986

[86] PCT No.: PCT/US86/00285

§ 371 Date: Sep. 17, 1987

§ 102(e) Date: Sep. 17, 1987

[87] PCT Pub. No.: WO87/04889

PCT Pub. Date: Aug. 13, 1987

[51] Int. Cl.[4] ..... H05B 41/14; H05B 41/38

[52] U.S. Cl. ..... 315/244; 315/291; 315/DIG. 2; 315/DIG. 5; 315/DIG. 7

[58] Field of Search ..... 315/98, 242, 244, 283, 315/307, DIG. 2, DIG. 5, DIG. 7, 85, 291; 363/39, 47

[56] References Cited

U.S. PATENT DOCUMENTS

| | | | |
|---|---|---|---|
| 3,525,900 | 8/1970 | Skirrin et al. | 315/246 X |
| 4,259,614 | 3/1981 | Kohler | 315/DIG. 7 X |
| 4,277,726 | 7/1981 | Burke | 315/DIG. 5 X |
| 4,288,724 | 9/1981 | Sherman | 315/DIG. 7 X |
| 4,392,085 | 7/1983 | Knoll et al. | 315/DIG. 5 X |
| 4,459,516 | 7/1984 | Zelina et al. | 315/219 X |
| 4,567,404 | 1/1986 | Flugan | 315/DIG. 5 X |
| 4,806,830 | 2/1989 | Veki | 315/DIG. 5 X |

*Primary Examiner*—David Mis

*Attorney, Agent, or Firm*—Albert O. Cota

[57] ABSTRACT

An improved ballast (10) that operates an ionic conduction lamp (40) such as a conventional phosphor coated fluorescent lamp. The ballast (10) comprises an ac/dc converter that converts an a-c power signal to a d-c power signal that drives a transistor tuned-collector oscillator (30). The oscillator is comprised of a high-frequency wave-shape generator (32) that in combination with a resonant tank circuit (36) produces a high-frequency signal that is equivalent to the resonant ionic frequency of the phosphor. When the lamp (40) is subjected to the high frequency, the phosphor is excited which causes a molecular movement that allows the lamp (40) to fluoresce and emit a fluorescent light. By using this lighting technique, the hot cathode of the lamp, which normally produces a thermionic emission, is used only as a frequency radiator. Therefore, if the cathode were to open, it would have no effect on the operation of the lamp. Thus, the useful life of the lamp is greatly increased.

18 Claims, 4 Drawing Sheets

BALLAST FOR IONIC CONDUCTION LAMPS

TECHNICAL FIELD

The invention pertains to the general field of generators or ballasts that are used to ignite and sustain the illumination of ionic conduction lamps and more particularly to a ballast that generates a high frequency signal equal to the resonant ionic frequency of the lamp where the signal suffices to ignite and maintain the lamps illumination.

BACKGROUND ART

The development of ballast's for operating ionic conduction lamps has progressed from conventional ballasts that operate at a low 60 Hertz frequency to those that operate at frequencies from 10 Kilohertz to 40 Kilohertz.

The low frequency ballast is generally a series reactor transformer which includes a large number of windings. Thus, the ballast acts as a inductive device that serves to both ignite the lamp and to also limit the current to the lamp. Immediately after the lamp is ignited, the impedance of the lamp drops to a very low level and, hence, it is necessary to limit the current after ignition in order to avoid burning the lamp. The inductive reactance in the ballast operates to limit the current after ignition of the lamp.

There are many disadvantages inherent in the conventional low-frequency ballast. One is the weight and size factor of the ballast. Due to the heavy transformer, provisions must be made in each lamp fixture to mount and support the weight of the ballast. Another, because of the coil and core design of the transformer, the ballast will not start at temperatures below 52° F. (11.1° C.).

The transformer core in the ballast often tends to vibrate and generate a hum in the audible frequency spectrum. While this hum may not have a great amplitude, it is, nevertheless, distracting and uncomfortable. In combination with the hum, the ballast also produces a low frequency "strobe effect" that causes irritation and headaches in many persons. The strobe effect is particularly noticeable at the peripheral vision of the eyes.

Large capacitors are often times required to correct the power factor and phase displacement. These capacitors are relatively expensive due to their size and thus substantially increase the overall weight and cost of the ballast.

The inductive device in the ballast often generates a significant amount of heat. In many cases, when the lamp is not mounted in an environment where air flow can dissipate the heat, other means must be employed to dissipate this heat. Additionally, if the ballast is operated for an excessive period of time, the heat buildup may damage the ballast necessitating replacement.

One of the significant disadvantages of conventional ballasts is that the ballast requires a substantial amount of electrical power for its operation in order to ignite and thereafter maintain energization of the lamp. A substantial amount of power is required to ignite the ionic conduction lamp and after the lamp has been ignited, a lesser but continuing current source is applied to the lamp in order to maintain its energization. The high-frequency ballast is discussed in the following U.S. patents which do not read on the claims of the instant invention but are indicative of the present state-of-the-art:

| U.S. Pat. No. | INVENTOR | ISSUED | |
|---|---|---|---|
| 4,286,194 | Sherman | 25 August | 1981 |
| 4,005,335 | Pepper | 25 January | 1977 |
| 3,889,153 | Pierce | 10 June | 1975 |
| 3,396,307 | Campbell | 6 August | 1968 |

The Sherman patent discloses a ballast that functions at an operating frequency within the range of 22 to 25 Kilohertz. The ballast is designed to start and maintain energization and operation of a load which has a relatively high impedance during starting and a substantially lower impedance after starting and during operation. The load is generally an ionic conduction lamp including a phosphor excitable lamp such as a fluorescent lamp. The inventor of the instant improved ballast has the rights to the Sherman patent. In the process of experimenting with the design several problems were uncovered which led to the improved ballast described infra. Three of the most notable problems are described below:

The transistor 42 and/or the diode rectifier bridge 26 were subject to catastrophic failure due to excessive voltage spikes generated within the circuit.

To operate the ballast it is necessary that current be applied through the heating filaments 52 of the fluorescent lamp L1 and L2. Thus, if a filament opens the ballast circuit is inoperative.

Because of the lamps high impedance at the start of the lamps ignition and the lower impedance after starting two impedance matching circuits are required.

In addition to the above problems, the Sherman patent has no provision to dim the lamp. This feature is particularly useful when less illumination is preferred and also provides a cost saving since less power is consumed with a lower light level.

The Pepper patent discloses a high frequency power source for fluorescent lamps. The device includes an inverter and an oscillator circuit that includes a transistor and a transformer that is connected to the lamp. A detector circuit is connected across the transistor output developed at one of the windings of the transformer. The circuit develops a control signal that varies as a function of the transistor output. The control signal is connected to the base of the transistor which is in parallel with the output of a feedback winding. When the control signal exceeds a predetermined value, the transistor output is changed to correspond to the required load.

The Pierce patent also discloses a high-frequency high-voltage power source for fluorescent lamps. The device includes an inverter with an oscillator and a transformer. The oscillator circuit comprises a transistor-set that has its emitter and collector electrodes connected in series with the primary winding of the transformer. The base of the transistor is connected across the transformer feedback winding. The circuits provide a lamp starting voltage and a reduced voltage after starting and during operation.

The Campbell patent discloses a fluorescent lamp ballast comprising a single transistor inverter circuit that allows the lamp to be operated from a direct current source. The transistor is connected, in series with the primary winding of an auto-transformer, across the d-c supply with a feedback connection from the transformer secondary to the transistor base electrode. The lamp load is connected in series with a capacitor across the transformer's secondary winding. A shunt capacitor is connected across the transformer secondary for load regulation under open circuit conditions when excessively high voltages might damage the transistor.

DISCLOSURE OF THE INVENTION

The invention provides an advancement in the state-of-the-art of ballasts that are used to control the operation of ionic conduction lamps such as the popular phosphor coated fluorescent lamp. The inventive ballast is a solid-state device that is basically comprised of an ac/dc converter that converts an a-c power signal into a d-c power signal that drives a transistor tuned-collector oscillator. The oscillator comprises a high-frequency wave-shape generator that in combination with a resonant tank circuit produces a high-frequency signal that is equivalent to the resonant ionic frequency of the phosphor in the lamp.

When the lamp, which is the load for the ballast, is subjected to the resonant ionic frequency, the phosphor is directly excited which causes a molecular movement that allows the lamp to fluoresce and emit a fluorescent light.

In conventional low-frequency and high-frequency ballasts. The hot cathode of the fluorescent lamp is heated by the ballast to produce a thermionic emission. This thermionic emission causes the lamp to ionize and illuminate. In the instant invention the lamps hot cathode is used only as a radiator for the impressed resonant ionic frequency. Therefore, if the cathode, which normally consists of a coil of tungsten wire, should open, it would have no effect on the operation of the lamp. Thus, the useful life of the fluorescent lamp is greatly increased. In view of the above discussion, it is the primary object of the invention to provide a ballast that allows a fluorescent lamp to illuminate by subjecting the lamp solely to the lamps resonant ionic frequency. In addition, it is also an object of the invention to provide a ballast that:

operates over a wide range of input power requirements including a d-c power input, operates at a high frequency that avoids the "strobe effect" that is prevalent in low-frequency devices. The strobe effect can cause irritation and headaches in many persons, can be designed, with the proper selection of components, to light one or a plurality of ionic conduction lamps, is ten times lighter than conventional low frequency ballasts. Conventional ballasts weigh 5 pounds (2.3 Kg) whereas the instant ballast weights 8 ounces (0.23 Kg).

can include a variable resistor that allows the lamp to be dimmed and operated at a lower power than is presently required for current ballasts.

These and other objects of the instant invention will become apparent from the subsequent detailed description of the preferred and second embodiment and the claims taken in conjunction with the accompanying drawings.

BEST MODE FOR CARRYING OUT THE INVENTION

The best mode for carrying out the improved ballast for ionic conduction lamps, hereinafter referred to as a ballast 10, is presented in terms of two embodiments: the first operates with an input of 120 volts a-c, 60 to 400 Hertz and includes an integrally connected lamp dimmer; the second operates on 220 volts a-c, 60 to 400 Hertz. Either embodiment may also be operated with an equivalent d-c power input.

In its simpliest terms, the ballast 10 consists of a means for generating a high frequency electrical signal that may range from 10 Kilohertz to 40 Kilohertz with a 20 Kilohertz signal preferred. The high frequency signal, which is connected across a phosphor excitable ionic conduction lamp or pair of lamps, provides direct excitation of the molecules in the phosphor which causes the lamp to ionize and illuminate.

Figure 1:
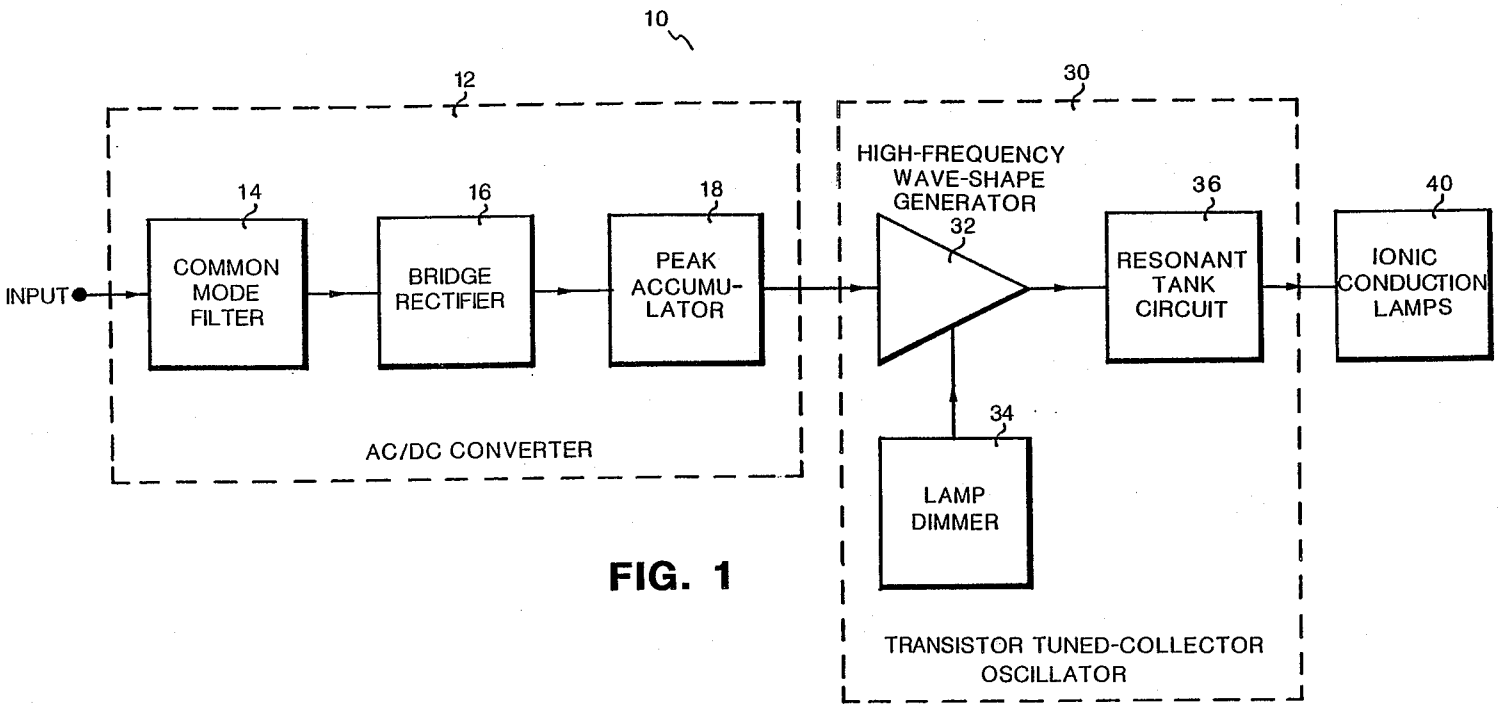
FIG. 1 is a block diagram of the improved ballast for ionic conduction lamps which includes the lamp dimmer as used in the first embodiment.
Figure 2:
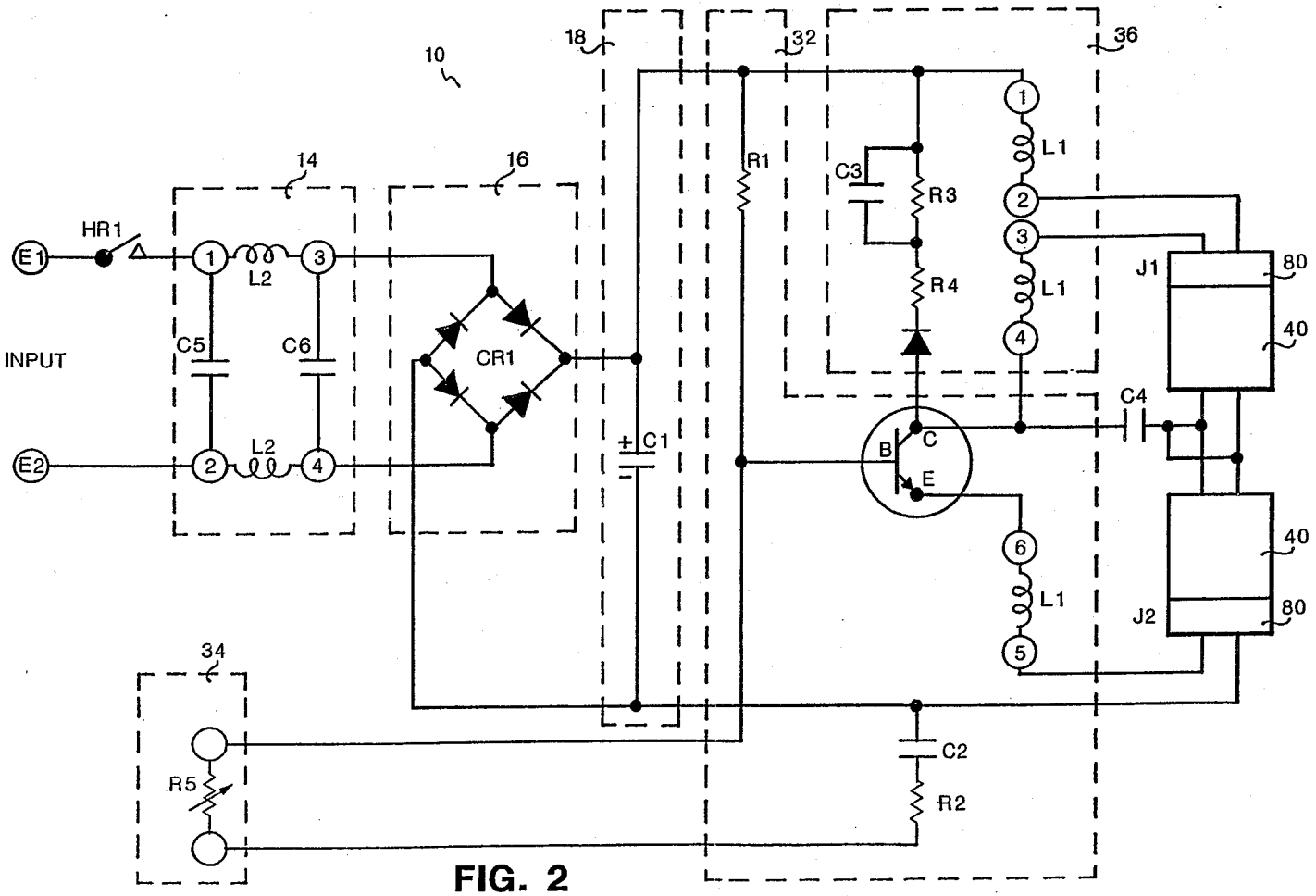
FIG. 2 is a schematic diagram of the ballast as configured for the first embodiment.

The first embodiment is shown in a block diagram in FIG. 1 and schematically in FIG. 2. The ballast 10, as shown in FIG. 1, is comprised of three basic elements: an ad/dc converter 12, a transistor tuned-collector oscillator 30 and a pair of ionic conduction lamps 40. The ac/dc converter 12 is further comprised of a common-mode filter 14, a full-wave bridge rectifier 16 and a peak accumulator 18; the oscillator 30 is further comprised of a high-frequency wave-shape generator 32, a lamp dimmer 34 and a resonant tank circuit 36. The ballast load comprises a standard ionic conduction lamp 40, such as a phosphor energizable fluorescent lamp, that is connected into a Leviton safety lamp socket J1 and J2 described infra. In the discussion that follows, and as shown in FIG. 2, only two lamps 40 are considered and described. However, by the selection of proper components and minor wiring changes, well known in the art, one or a larger quantity of lamps can be operated by the ballast.

The a-c power to the ballast 10 is applied, as shown in FIG. 2, across terminals El and E2 through a thermal breaker HR1. The filter 14 is a low-pass filter that minimizes spontaneous changes in the a-c input signal such as noise spikes and reduces the ripple factor of the subsequent d-c signal from the rectifier 16. The filter 14 consists of a two-coil inductor L2 having a high voltage capacitor C5 connected across the filter input terminals 1 and 2 and a second high voltage capacitor C6 connected across the filter output terminals 3 and 4.

The a-c signal output of the filter 14 (terminals 3 and 4 of inductor L2) is connected across the full-wave bridge rectifier CR1, 16. The resultant d-c signal from the rectifier 16 is applied to the positive side of capacitor Cl which comprises the peak accumulator 18. The accumulator capacitor Cl operates as a ripple filter and stores and provides the d-c energy that is required to turn-on a high-power NPN transistor Q1. The transistor is a component of the high-frequency wave shape generator 32 which is an element of the transistor tuned-collector oscillator 30. The generator 32, in addition to transistor Q1, and a section of L1 is comprised of transistor bias resistors R1, R2 and R5 and capacitor C2 which is connected to the signal return as shown in FIG. 2.

The turn-on of transistor Q1 is controlled by the combination voltages present at the transistor collector (C) and the bias voltage on the base (B). Before Q1 turns-on, the accumulator capacitor C1 is charged to a peak voltage. This potential voltage is applied through terminals 1 and 2 of inductor L1 and to one side of lamp connector J1. The current flow continues through the lamp 40 and out the other side of J1 through terminals 3-4 of L1 to the transistor collector (C). After Q1 turns-on, the voltage from the emitter (E) is applied through terminals 6-5 of L1, and through connector J2 to signal ground.

The transistor base bias is provided by the discharge of capacitor C1 through resistor R1, the lamp dimmer resistor R5 resistor R2, and capacitor C2 to the signal return. The resistor R2 and capacitor C2 also operate in combination as a current limiting device to keep the current level within a range that can be tolerated by transistor Q1. Therefore, the resistance of R2 must be sufficiently high to eliminate transients from being applied to the base of the transistor. By referring to FIG. 2 it can also be seen that as the voltage changes, the base drive to the transistor through capacitor C2 would also change. The resistor R1 further controls the voltage drop across the transistor to permit the bias on the base (B) to start the transistor.

When the magnitude of the transistor base current is sufficient to produce a current flow through terminals 6 and 5 of the feedback coil of inductor L1 and the lamp 40 via the lamp socket J2 the transistor 11 turns on. Diode CR3 connected across the transistor emitter collector circuit protects the transistor from a potential catastrophic failure caused by excessive voltage such as from switching spikes that may be produced by the feedback coil of inductor L1.

When the transistor 11 turns-on it oscillates at a resonant frequency provided by the current flow through diode CR2, resistor R4, the parallel circuit of resistor R3 and capacitor C3 and back through terminals 1-4 of the collector coil of inductor L1. The resonant frequency is set by the selection of proper components, to range between 10 Kilohertz and 40 Kilohertz with the preferred frequency being 20 Kilohertz. In all cases, the resonant frequency is selected to be equivalent to the resonant ionic frequency of the lamp 40. The resonant tank circuit 36 is comprised of terminals 1-4 of the collector coil of inductor L1, the parallel circuit of resistor R3 and capacitor C3, and resistor R4. Diode CR2 connected between the transistor collector and resistor R4 ensures that the transistor is turned on through inductor L1 rather than through resistors R3 and R4. Capacitor C4 provides the a-c coupling of the lamp 40 to the transistor to provide d-c excitation. Thus, all d-c voltage is blocked and substantially only an a-c voltage is applied to the lamps. In addition to the resonant frequency being sufficient to directly excite the phosphor coating of the lamp 40 to cause illuminations, it also makes the light output of the lamp more compatible with human visual sensory requirements. In other words, the so called "strobe effect" which is prevalent in current ballast/lamp designs operating at 60 Hertz is greatly reduced. The strobe effect, which is especially noticeable at the peripheral vision area, causes irritation and headaches in many persons.

Figure 4:
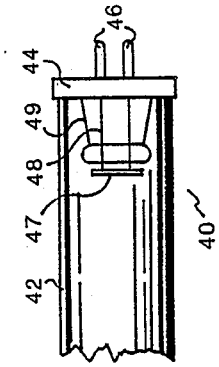
FIG. 4 is a partial cutaway side view of a typical ionic conduction lamp.

The ballast load in the preferred and second embodiment comprises a pair of ionic conduction lamps 40. These lamps are of conventional construction and are comprised, as shown in FIG. 4, of a bulb or tube 42, which is shown as a straight glass tube although the tube could be made in other shapes such as circular, U-shaped or the like. Each end of the tube 42 is provided with a non-conductive base 44 having a pair of electrical terminals 46. These terminals, which are often referred to as "base pins", are connected to a corresponding pair of lead-in wires 48 located internally within the tube. The lead-in wires are located in a "stem press" 49 constructed of a material to assure the same coefficient of expansion as the glass tube 10. The lead-in wires 48 are connected to a hot cathode 47 that is coated with an emissive material which emits electrons and is usually made of a coil of tungsten wire.

The inside of tulle 42 has a phosphor coating which transforms ultraviolet radiation into the visible fluorescent light produced by the phosphor. A small quantity of mercury is also located within the bulb 42 to furnish a mercury vapor for purposes of ignition and to sustain the ultraviolet radiation. In addition, an inert gas such as argon, krypton and the like may also be included within the tube to aide in the ignition of the lamp 40.

When the conventional or other improved ballasts are used, the hot cathode 52 is energized. When the cathode reaches an operating temperature of 950° C., a thermionic emission occurs that emits electrons. The emitted electrons, upon collision and with the aide of the mercury vapor, release ultraviolet radiation which is converted into the visible fluorescent light produced by the phosphor.

In the instant invention of the ballast 10, the hot cathode is not heated. Therefore, there is no thermionic emission. Rather the cathode merely serves as a means to radiate the impressed resonant ionic frequency. The application of the resonant frequency on the electrical terminals 46 is all that is necessary to cause the lamp to ionize and cause the phosphorto fluoresce. Therefore, if the coil of the hot cathode 52 were to open, it would have no effect on the operation of the lamp 40 because the cathode is serving only as a radiator. Thus, the useful life of the lamp is greatly increased.

The fluorescense or illumination of such a phosphor coated lamp 40, when used in the instant invention, is based on the phenomenom that if the lamp is subjected to the resonant ionic frequency of the phosphor, the phosphor will be excited causing a molecular movement which causes the phosphor to fluoresce and emit a fluorescent light. The use of the high frequency also negates the need for the mercury to sustain the excitation of the phosphor.

Other forms of ionic conduction lamps/gaseous discharge lamps such as various types of electroluminescent lamps, various metal vapor lamps which include the sodium vapor lamp and the mercury vapor lamps may also be operated by the ballast 10 in the manner previously described.

Figure 3:
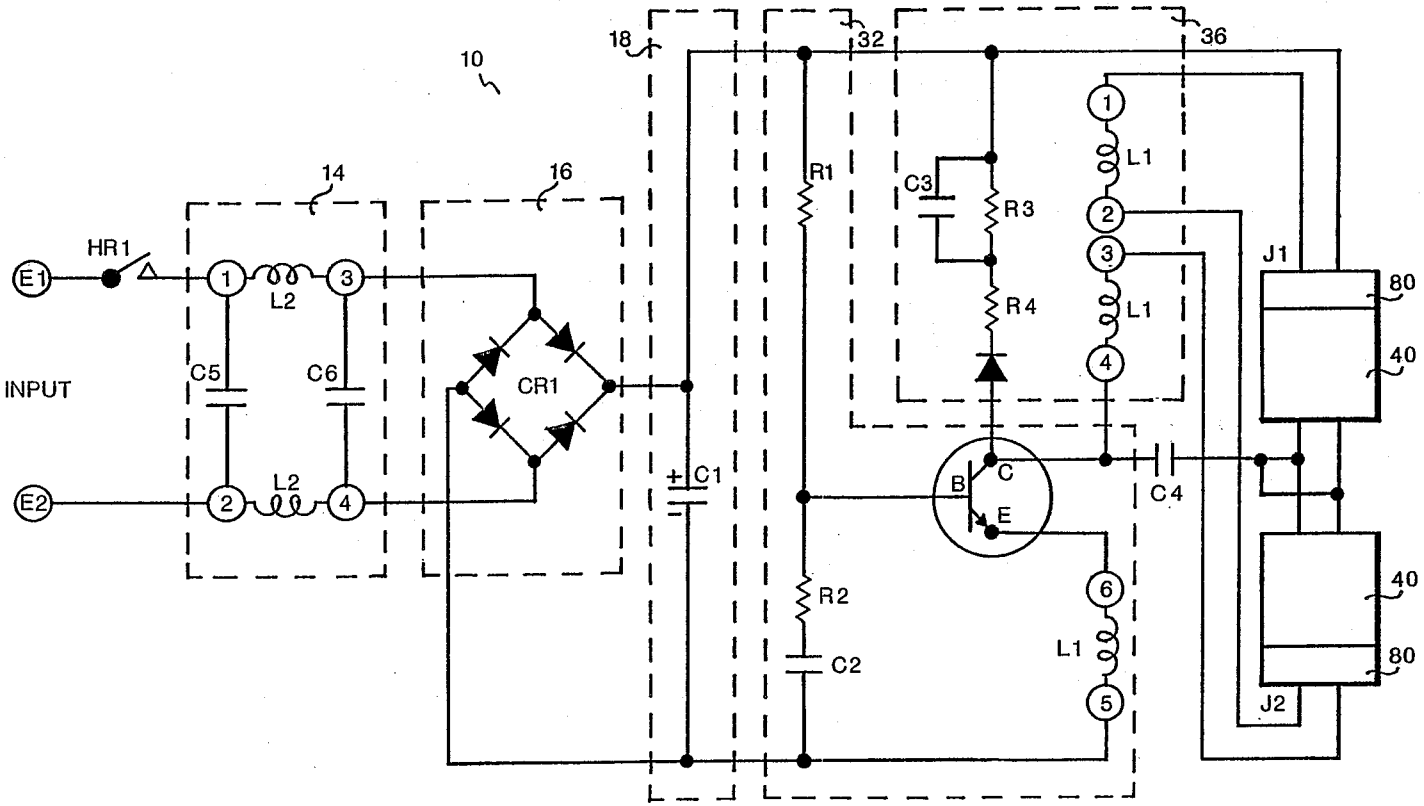
FIG. 3 is a schematic diagram of the ballast as configured for the second embodiment.
Figure 5:
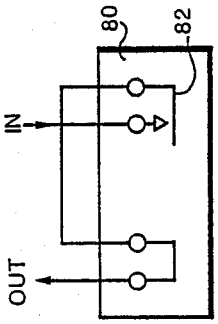
FIG. 5 is a schematic view of the lamp socket showing the integral interlock switch.

The lamp socket J1 and J2 also serves as a safety device that prevents an accidental electrical shock. This connector, as shown schematically in FIG. 5, incorporates an integral interlock switch 82 that is in series with the lamp load circuit-as shown in FIGS. 2 and 3. When the lamp is not plugged into the connectors, the switch remains in the open position, thus removing any voltage from the connector terminals.

The lamp dimmer 34, as shown in FIG. 2, is comprised of a variable resistor R5. The dimmer controls the illumination level of the lamp 40 by varying the bias voltage applied to the base (B) of transistor 11 thereby controlling the conduction cycle of the transistor's output waveform. The change in the bias changes the class of operation of the oscillator from class A to class C to complete cutoff. When operating in class A the output current follows the input bias current. When operating in class C, the output current follows the input bias current and the output current is zero for more than one-half of the input sinesoidal signal cycle. Thus, the dimmer 34 changes the frequency of excitation at the resonant energy. Dimmer terminals are provided on the ballast 10 enclosure to allow the dimmer to be located externally on a nearby wall. The dimmer is designed to replace a conventional wall mounted on-off switch.

The second embodiment, as shown schematically in FIG. 3, operates on an industrial input voltage of 220 volts a-c 60–400 Hz, or an equivalent d-c voltage, and allows the use of higher voltage rated lamps 40.

Essentially, the circuit differs only in the elimination of the lamp dimmer and in the configuration of the output circuit. The output circuit requires more energy to activate both of the lamps 40 at start-up. Therefore, before transistor 11 turns-on, a potential voltage is applied across both lamps 40 via connectors J1 and J2.

At start-up, the current flows sequentially through connector J1, terminals 1-2 of inductor L1 and on to the collector (C) of transistor 11. After 11 turns-on, the current flows through terminals 6-5 of L1 to the signal ground.

Although the lamp dimmer is eliminated, the lamps 40 may still be dimmed by conventionally connecting the input of the ballast to an auto transformer, such as a VARIAC (not shown), that is connected to the 220 v a-c power. VARIAC is a trademark of Technipower/-Penril, Danbury, Conn., United States of America.

The remaining paragraphs are applicable to both the first and second embodiment of the ballast 10.

Figure 8:
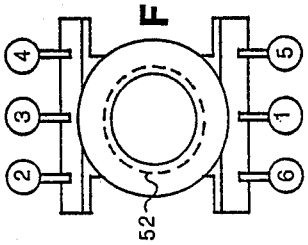
FIG. 8 is a top view of the inductor L1 bobbin.
Figure 7:
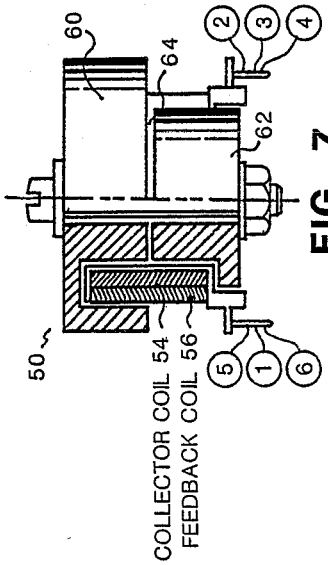
FIG. 7 is a cross sectional side view of the inductor L1 bobbin showing the configuration of the cores and core gap.
Figure 6:
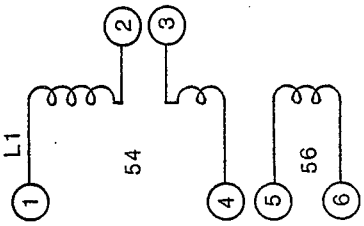
FIG. 6 is a schematic diagram of inductor L1.

One of the inherent novelties of the ballast 10 is in the method used to compensate for differences in the lamps 40 high impedance prior to starting and during the starting cycle and the substantially lower impedance after starting and during operation. These impedance differences are compensated, in part, by the design of the high frequency inductor L1 which is shown in FIGS. 6–8. The inductor functions as a controlled hysteresis loop resonant device that is designed so that the "Q" multiplication occurs prior to the ionic ignition/-conduction of the lamp 40. The lamps ignition causes a reduction in "Q" and drives the inductor's core into magnetic saturation. At saturation, the lamp voltage is lowered to the level necessary to sustain conduction.

The collector coil and feedback coil of inductor L1 are wound on a core inductor 50 as shown in FIGS. 7 and 8. The high frequency operation of the ballast circuit allows the use of highly efficient core materials. These materials are generally frequency dependent and should be selected to provide a narrow hysteresis loop.

The inductor 50 comprises a cylindrically shaped center spool 52 upon which the collector and feedback coils are conventionally wound as best shown in FIG. 7. The spool 52 is formed of an electrically nonconductive material such as a plastic. In the preferred embodiment, the spool is made of an Underwriter Laboratory (UL) approved glass/nylon composition. The spool is housed in a housing consisting of an upper housing section 60 and a lower housing section 62. The housing pair is designed to enclose the magnetic lines of force and are separated, by a gap 64 of 0.008 inches (0.02 cm). It has been found that the overall efficiency and effectiveness of the ballast is enhanced by designing the inductor with such a gap 64. The gap space is critical. If the gap is too small, energy savings are decreased, and if the gap is too large, the inductor could burn out the transistor 11. Additionally, if the gap is too small, the magnetic material forming part, of the core is brought into saturation. The saturation occurs because there is both direct and alternating current in the collector coil 54 with the direct current superimposed on the alternating current. Therefore, by increasing the gap 64 to the proper dimension, the possibilities of magnetic saturation is reduced. When the gap is too large, the transistor burn-out occurs because the voltage becomes too high for the low inductance.

The number of turns of the collector coil 54 and the feedback coil 56 is a function of the gain of the transistor 11. If the gain of the transistor is high, the number of turns of the feedback coil 56 is relatively few. Conversely, if the transistor gain is low then a larger number of turns feedback coil is required.

The high frequency used to operate the inductor additionally reduces the size and weight of the inductor required to ignite the phosphor into illumination. The high frequency also is non-perceivable to the human eye thus, reducing subjective fatigue and further increasing the light perceived by the eyes.

Figure 11:
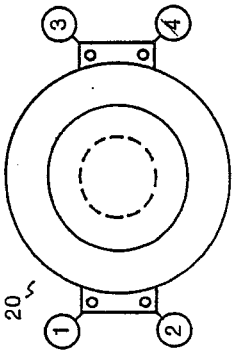
FIG. 11 is a top view of the inductor L2 bobbin.
Figure 10:
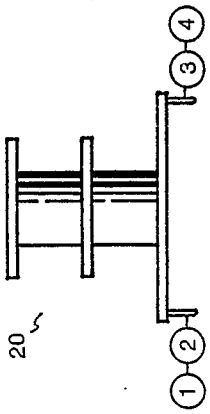
FIG. 10 is a side view of the inductor L2 bobbin.
Figure 9:
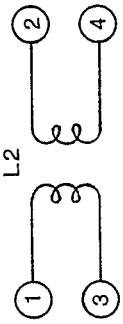
FIG. 9 is a schematic diagram of inductor L2.

The inductor L2 which functions as a part of the low-pass filter 14 is shown schematically in FIG. 9 and the side and top view of the bobbin 20 on which the filter is wound is shown in FIGS. 10 and 11 respectively. The construction details of this filter is well known in the art and are therefore not described.

The turns ratio for inductors L1 and L2 in both embodiments as well as other related data is shown in Table I.

TABLE I

| EMBODIMENT | INDUCTOR | TERMINALS | TURNS | WIRE AWG |
|---|---|---|---|---|
| 1 | L1 | 1–2 | 109 | 24 |
| 1 | L1 | 3–4 | 35 | 24 |
| 1 | L1 | 5–6 | 11 | 24 |
| 1 and 2 | L2 | 1–3 | 20 | 24 |
| 1 and 2 | L2 | 2–4 | 20 | 24 |
| 2 | L1 | 1–2 | 160 | 26 |
| 2 | L1 | 3–4 | 43 | 26 |
| 2 | L1 | 5–6 | 16 | 26 |

The input voltage and voltage frequency tolerance of the ballast 10 makes the invention not voltage or frequency sensitive. This feature is particularly useful in areas where grayouts or brownouts are prevalent. During these periods, the ballast will continue to operate the lamps at full illumination or at a partial illumination for a longer period of time that is now possible with current ballast designs. The ballast 10 is designed to allow the first embodiment to operate over a voltage range of d-c to 130 v a-c, 60 to 400 Hz while the second embodiment to operate at 150 to 280 v a-c, 60 to 400 Hz. This wide range of power inputs allows the ballast to be operated from power sources available from the electrical systems of mobile apparatuses such as used on automobiles, airplanes and the like. Comparative testing and measurement of the ballast 10 with current designs has also shown that the ballast 10 operates at lower temperatures and weighs less than current designs.

The ballast 10 is enclosed in a magnetic steel enclosure (not shown) to minimize the effects of electromagnetic interference (EMI). Radio frequency interference (RFI) is minimized by inductor L2 which filters much of the high frequency.

In the construction of the preferred and second embodiments the parts shown in TABLE II were used:

TABLE II

| REF DESIGNATOR | | |
|---|---|---|
| C1 | Capacitor | 4.7 uf, 450 v |
| C2 | Capacitor | 0.022 uf, 600 v |
| C3, C5, C6 | Capacitor | 0.06 uf, 1.6 kv |
| C4 | Capacitor | 0.003 uf, 3 kv |
| R1, R3 | Resistor | 330 k ohms, 0.5 w |
| R2 | Resistor | 150 ohms, 2 w |
| R4 | Resistor | 220 ohms, 1 w |
| R5 | Rheostat | 1000 ohms, 2 w |
| CR1 | Rectifier Bridge | 1.5 amps, 1 kv |
| CR2, CR3 | Diode | 1 amp , 2 kv |
| HR1 | Thermal Breaker | |
| Q1 | High-Voltage NPN Transistor | |
| L1 | Inductor | (see Table I) |
| L2 | Inductor | (see Table I) |

The improved ballast 10 as described fulfills all of the objects and advantages sought therefore, it should be understood however, that many changes, modifications, variations and other uses and applications will become apparent to those skilled in the art. Therefore, any and all such changes, modifications, variations, and other uses and applications which do not depart from the spirit and scope of the invention are deemed to be covered by the invention which is limited only by the claims.

I claim:

1. An improved ballast for ionic conduction lamps comprising:

(a) an electrical power supply, (b) means for generating a high frequency electrical signal where said generating means is powered by said power supply, and (c) a phosphor coated ionic conduction lamp connected to the high frequency electrical signal from said generating means where the signal excites the phosphor causing said lamp to ioieze and illuminate.

2. An improved ballast for ionic conduction lamps comprising:

a) an a-c power source, b) an ac/dc converter that converts an a-c power signal from said a-c power source to a d-c power signal, c) a transistor tuned-collector oscillator receiving the d-c signal from said ac/dc converter where said oscillator generates a high frequency electrical signal, and d) a ballast load comprising an ionic conduction lamp connected across the output of said oscillator where the high-frequency electrical signal produced by said oscillator causes said lamp to ionize and illuminate.

3. An improved ballast for ionic conduction lamps comprising:

a) an a-c power source, b) an ac/dc converter that converts an a-c power signal from said a-c power source into a d-c signal where said converter further comprises:

(1) a common-mode filter that receives and converts the a-c power signal to a spike-suppressed a-c signal, (2) a full-wave bridge rectifier- that receives and converts the a-c signal from said filter to a d-c signal, (3) a peak accumulator that receives and accumulates the d-c signal from said rectifier, c) a transistor tuned-collector oscillator that generates a high-frequency electrical signal where said oscillator further comprises:

(1) a high-frequency wave-shape generator having a transistor that is turned-on by the d-c signal from said peak accumulator, (2) a resonant tank circuit designed to resonate at a high-frequency where said tank circuit is energized when the transistor in said generator turns-on, and d) a ballast load comprising an ionic conduction lamp connected across the output of said resonant tank circuit where the high-frequency electrical signal from said tank circuit causes said lamp to ionize and illuminate.

4. The improved ballast as specified in claims 2 or 3 wherein said a-c power source input to said ac/dc converter for the first embodiment is 0 to 130 v a-c, 60 to 400 Hertz.

5. The improved ballast as specified in claims 2 or 3 wherein said a-c power source input to said ac/dc converter for the second embodiment is 150 to 280 v a-c, 60 to 400 Hertz.

6. The improved ballast as specified in claim 3 wherein said common-mode filter comprises a two-coil inductor.

7. The common-mode filter as specified in claim 6 wherein each of said coils has 20 turns of 24 AWG wire.

8. The improved ballast as specified in claim 3 wherein said resonant tank circuit comprises an inductor having a tapped collector coil and a feedback coil.

9. The inductor as specified in claim 8 wherein said collector coil of the first embodiment has 109 turns of 24 AWG wire across terminals 1 and 2 and 35 turns of 24 AWG wire across terminals 3 and 4, and where the feedback coil of the first embodiment has 11 turns of 24 AWG wire across terminals 5 and 6.

10. The inductor as specified in claim 8 wherein said collector coil of the second embodiment has 160, turns of 26 AWG wire across terminals 1 and 2 and 43 turns of 26 AWG wire across terminals 3 and 4, and where the feedback coil of the second embodiment has 16 turns of 26 AWG wire across terminals 5 and 6.

11. The improved ballast as specified in claims 2 or 3 wherein said high frequency signal is equivalent to the resonant ionic frequency of said lamp.

12. The improved ballast as specified in claim 3 further comprising a lamp dimmer that controls the illumination of said lamp by varying the bias on said transistor located in said high-frequency wave-shape generator.

13. The improved ballast as specified in claims 2 or 3 further comprising a safety lamp connector incorporating an integral interlock switch that removes any voltage from the connector terminals when said lamp is not plugged into said connector.

14. The improved ballast as specified in claims 2 or 3 wherein said ionic conduction lamp consists of a phosphor energizable fluorescent lamp.

15. The improved ballast as specified in claim 14 where said ballast allows said lamp to illuminate without the need for a thermionic emission occurring within the lamp tube.

16. The improved ballast as specified in claims 2 or 3 wherein the input to said ballast may be a d-c power signal equivalent to the applicable a-c power signal.

17. The improved ballast as specified in claims 2 or 3 wherein said ballast load comprises a plurality of ionic conduction lamps.

18. The improved ballast as specified in claims 2 or 3 wherein said ballast is enclosed in a magnetic steel enclosure to minimize the effects of electro-magnetic interference (EMI).

* * * * *